United States Patent [19]

Meier et al.

[11] 4,250,824

[45] Feb. 17, 1981

[54] METHOD AND DEVICE FOR FORMING AN OVERCAST SEAM WITH A ZIG-ZAG SEWING MACHINE

[75] Inventors: Günter Meier; Rolf Kessler, both of Karlsruhe-Durlach, Fed. Rep. of Germany

[73] Assignee: Dorina Nähmaschinen GmbH, Fed. Rep. of Germany

[21] Appl. No.: 96,249

[22] Filed: Nov. 20, 1979

[30] Foreign Application Priority Data

Dec. 2, 1978 [DE] Fed. Rep. of Germany ..... 2852299

[51] Int. Cl.[3] ..... D05B 1/20; D05B 3/02

[52] U.S. Cl. ..... 112/269.1; 112/162; 112/158 R

[58] Field of Search ..... 112/269.1, 162, 158 R, 112/235

[56] References Cited

U.S. PATENT DOCUMENTS

| | | | |
|---|---|---|---|
| 1,509,111 | 9/1924 | Saleeby | 112/269.1 |
| 3,126,850 | 3/1964 | Sigoda | 112/162 |
| 4,155,320 | 5/1979 | Aubort | 112/269.1 |

*Primary Examiner*—Peter P. Nerbun

*Attorney, Agent, or Firm*—McGlew & Tuttle

[57] ABSTRACT

A method for the formation of an overcast seam by means of a zig-zag sewing machine. After the formation of the first looping of needle and looper thread in a first overstitch position of a needle bar the needle thread is loosened and the needle bar moves into a second overstitch position, in which a further thread looping takes place. After the formation of at least one straight stitch in the second overstitch position, the joining thread between the first two thread looping is drawn out, forming a loop in the first overstitch position, the needle pierces into the loop, after which it is released. The seam thus formed is a firm joining seam by which the sewing material is not gathered between the thread loopings. The method is carried out on a device which comprises an oversewing tongue to which is assigned, in order to obtain two successive motional phases, a starting handle arranged in the swinging path of the needle bar, and a starting handle arranged in the axial path of motion, for the first overstitch position and into whose path of motion protrudes a loop stripper. The needle bar thus controls the drawing out and casting off of the joining thread between the first two thread loopings.

7 Claims, 6 Drawing Figures

METHOD AND DEVICE FOR FORMING AN OVERCAST SEAM WITH A ZIG-ZAG SEWING MACHINE

FIELD AND BACKGROUND OF THE INVENTION

The present invention relates in general to sewing machines and, in particular to a new and useful method and device for forming overcast seams using a standard zig-zag sewing machine.

From German OS No. 28 11 455 is known a method for the formation of a seam that can be used as an edge finishing seam on a zig-zag sewing machine, according to which the third of three forward stitches is made by changing the lateral stitching position. The first of the four forward stitches is made by changing the stitch position, and the following two are made in this stitch position. The fourth is made again by changing the stitch positon, and so on whereby the stitches spaced from the cloth edge are sewn by reversing the direction of feed. In this way needle and bobbin thread are formed concatenated at each penetration of the needle, both on the outer edge of the cloth and at a distance thereof, hence in both overstitch positions of the needle. All overstitches are made in the direction of feed.

Since this seam is only formed by controlling the overstitch movements of the needle and the feeding movements of the cloth feed, so that it is a pure zig-zag seam, it has the inconvenience inherent in all known zig-zag seams namely, that it must be sewn with a much lower tension of needle and bobbin thread than a straight seam, in order to keep the unavoidable unsightly gathering of the seam, and thus of the sewing material at a minimum, which is particularly conspicuous in the production of an edge finishing seam. But this cannot be completely avoided in the production of a zig-zag seam if an orderly and still sufficiently firm concatenation of needle-and bobbin threads is to be achieved by tying the stitch.

When changing from sewing a zig-zag seam to sewing a straight seam and vice versa, a readjustment of the tension of needle and bobbin thread cannot be avoided. Readjustment of the tension is mostly not possible the first time, but only after a few tension changes and subsequent sewing tests. This means that considerable time is lost.

In the production of festoon and fancy seams, it is known to use a twin needle sewing machine (German Pat. No. 285,182), which is equipped with a thread puller by which the thread of one needle is pulled out and offered to the other needle for penetration in order to avoid bending stresses of the needle. The control of the thread puller requires a relatively complicated fixer gear which is installed in the machine. The machine becomes thus a special machine for the production of two parallel seams where the thread of one needle is merely looped with that of the other needle in the manner of a festoon. As a single purpose machine, it is unsuitable for use in private households.

SUMMARY OF THE INVENTION

The present invention is based on the problem of developing a method for the formation of an overcast seam according to which a seam can be produced by which, for example, two layers of cloth are joined with each other firmly and lastingly and not gathered in the range of the seam, so that the seam is suitable for joining and bordering particularly thin materials, knittings and similar elastic materials.

Accordingly, an object of the present invention is to provide a method for forming an overcast seam using a zig-zag sewing machine with a needle bar carrying a needle with needle thread movable into first and second overstitch positions and having a looper with looper thread and a material feeder for feeding material in a feed direction comprising, forming a first loop of needle and looper thread with the needle bar in its first overstitch position, moving the needle bar with needle thread into the second overstitch position leaving a loosened thread length between the first and second needle loop, forming a second loop of needle and looper thread with the needle in its second overstitch position, forming at least one straight stitch with the needle bar in its second overstitch position in the feed direction of the material, pulling the loosened thread length between the first and second loops into the first overstitch position to form an overstitch loop into which the needle moves to form a subsequent loop, and releasing the overstitch loop.

In order to keep the tensile stress of the thread to be pulled out to form a loop, at a minimum, it is further suggested to effect the pulling of the thread into the first overstitch position by reversing the direction of feed of the sewing machine.

Another object of the present invention is to provide a device for carrying out the method comprising a tongue mandrel which is provided with a abutment member arranged in the swinging path of the needle bar in order to obtain two successive motion phases with another abutment member disposed in the axial path of the needle bar in the first overstitch position. A loop stripper protrudes into the path of motion of the needle bar for disengaging thread from the oversewing tongue.

A still further object of the present invention is to provide a device as set forth above where the oversewing tongue comprises a tongue arranged on a shaft which carries the abutment members.

A further object of the present invention is to provide a device as above wherein the shaft is mounted on a presser foot of the sewing machine.

A still further object of the present invention is to provide a device for forming an overcast seam using a zig-zag sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
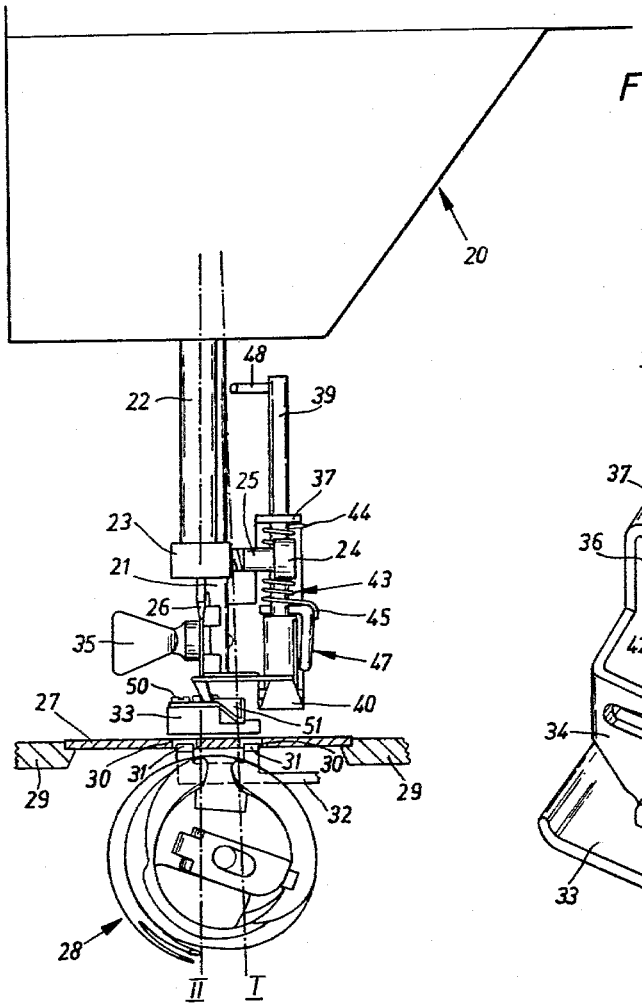
FIG. 2 is a front view of the device arranged on the presser bar of a zig-zag sewing machine indicated in the drawing, substantially in natural size.
Figure 1:
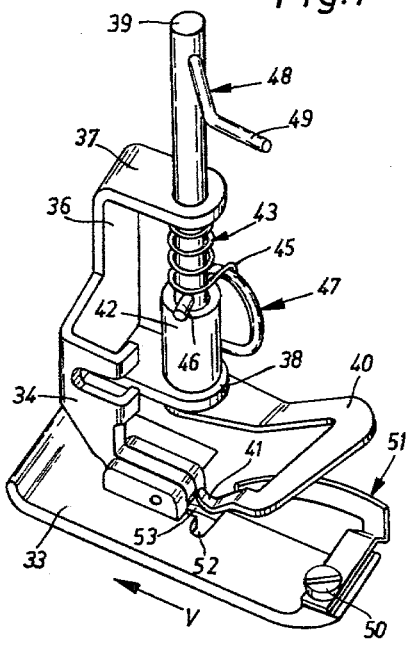
FIG. 1 is a perspective view of the device for carrying out the new method on an enlarged scale.

Turning to the drawings in particular, the invention embodied therein. FIGS. 1 and 2 comprise the working head generally designated 20 of a standard zig-zag sewing machine which has a needle bar 22 for carrying a needle 26 having needle thread, and a presser bar 21 which carries additional apparatus used in accordance with the invention shown in FIG. 1.

In head 20 of the zig-zag sewing machine, by means of which the method is to be carried out, are arranged a spring-loaded presser bar 21 and a needle bar 22. At the bottom end of needle bar 22 is arranged a needle holder 23, in which needle 26 is secured by means of a fastening screw 25 provided with a cylindrical head 24. Needle 26 cooperates with a thread-carrying looper 28 arranged under needle plate 27 for the formation of stitches. Needle bar 22, in known manner, is caused to move in vertically ascending and descending directions and selectively transversly thereto in swinging movements between the overstitch positions designated I and II in FIG. 2.

Needle plate 27 which is secured onto a cloth support 29 of sewing machine 20 is provided with a slot (not shown) for the passage of needle 26 and has two oblong slots, 30, through which toothed webs 31 of a cloth feed or feeder 32 performing a rectangular movemement in known manner, pass upwardly to advance the sewing material.

A cloth presser sole 33 cooperates with webs 31, and is articulated on a shaft 34. Shaft 34 is secured by means of a thumb screw 35 on the bottom end of presser bar 21, which is resiliently depressed by a pressure spring (not shown).

Shaft 34 is extended toward one side and forms a bearing yoke 36 with two angularly bent-off bearing straps 37,38 in which a shaft 39 is mounted for rotation and longitudinal displacement.

At the end of shaft 39, projecting toward the outside through bearing strap 38 is secured an angle lever 40 whose free end points in the direction of feed of the sewing material (arrow V) and which forms an oversewing tongue 41. Between the two bearing straps 37 and 38 are arranged, on shaft 39, a spacer sleeve 42 and a torsion spring 43 which has two free arms 44, 45. Shaft 39 is secured in the axial direction by the straight end 46 of a abutment member 47 which bears on sleeve 42, and which passes with a tight fit through a transverse bore in shaft 39. Abutment member 47 protrudes in the overstitch position I of needle bar 22, into the path of motion of cylindrical head 24 of needle fastening screw 25. A pin 48 is pressed with a tight fit into a transverse bore at the upper end of shaft 39 which has a free bent-off end 49, which is arranged in the swinging path of needle bar 22 and serves as an abutment for the needle bar.

One free arm 44 of torsion spring 43 bears on bearing yoke 36, while the other free arm 45 acts on the abutment member 47. Due to this arrangement of torsion spring 43, shaft 39 with the parts arranged thereon is normally held in the position shown in the drawing.

On presser sole 33 is secured, by means of a screw 50, a loop stripper 51, which extends in an arch from its fastening point on sole 33 to oversewing tongue 41 and whose front edge is arranged in the path of motion of oversewing tongue 41.

It should be mentioned that a recess 52 is provided in presser sole or foot 33 for the passage of needle 26, and that a stitch-forming tongue 53 extending with its free end in the direction of feed of the sewing material (arrow V) and, protruding into a groove (not shown) on the underside of the sole, is secured in sole 33.

Realization of the method and mode of operation of the device is as follows: At the start, sewing material W is placed on cloth support 29 and needle plate 27 so that the right hand edge K extends close to the point of penetration of needle 26 in its overstitch position I of needle bar 22. The presser bar spring is pressed over presser sole 33 which is arranged on shaft 34, onto needle plate 27 and onto webs 31 of cloth feed 32. Needle bar 22 is in overstitch position I with needle 26 outside sewing material W, and shaft 39 is so turned during the swinging movement of needle 26 in overstitch position I by pin 48, 49 cooperating with needle bar 22 and acting as an abutment for the latter, that oversewing tongue 41 assumes its pullout position, as shown in FIG. 3, for example.

When the sewing machine is started, needle 26 pierces first at point 1, (FIGS. 4 to 6), and a looper thread is formed. In order to obtain a seam according to FIG. 4, needle bar 22 moves into overstitch position II, without sewing material W being displaced. Abutment members 47 and 48 are released and shaft 39 with oversewing tongue 41 is turned by torsion spring 43 into the position shown in FIGS. 1 and 2. During this swinging movement of needle bar 22, needle thread NF is placed over oversewing tongue 41 so that it has a greater length than the distance between points 1 and 2. Needle 26 pierces sewing material W at point 2, and the next concatenation of needle thread NF and bobbin thread GF takes place. In overstitch position II, sewing material W is now displaced by one stitch length in the direction of feed arrow V, while needle 26 is outside sewing material W during its axial movement. The next penetration of needle 26 is then at point 3. After the formation of the loop of needle thread NF and bobbin thread GF in point 3, needle bar 26 also performs during its axial movement a swinging movement into overstitch position I for the penetration of needle 26 at point 4. During this swinging movement the part of the thread arranged on oversewing tongue 41 is pulled out between points 1 and 2 to an overstitch loop S, with needle bar 22 striking first the bent-off end 49 of pin 48 and shaft 39 with oversewing tongue 41 being so turned that overstitch loop S is offered to needle 26 for penetration at point 4. When needle 26 has pierced loop S, shaft 39 with oversewing tongue 41 is turned by cylindrical head 24 of needle fastening screw 25 striking abutment member 47 during the further descending movement of needle bar 22 so that loop S is stripped off from oversewing tongue 41 by the cooperation of oversewing tongue 41 with loop stripper 51, past the front edge of which oversewing tongue 41 moves. Due to the looping of needle thread NF and bobbin thread GF in point 4, loop S bordering the cloth edge is tied up. The thread loop in point 4 forms at the same time the first thread loop 1' of another stitch sequence 1'–4' with loop S' whose tie-in at point 4' is followed by the stitch sequence 1" to 4" with loop S". In this way a loose overcast seam is formed which is at the same time a longitudinally extensible and still durable joining seam with straight stitches 2–3, 2′–3′, 2″–3″. The longitudinal extensibility is due to the fact that the above mentioned straight stitches are not joined directly in the direction of feed one behind the other, but over the part of the needle thread loops S, S′ and S″ above the part transverse to the direction of feed, arrow V.

Figure 5:
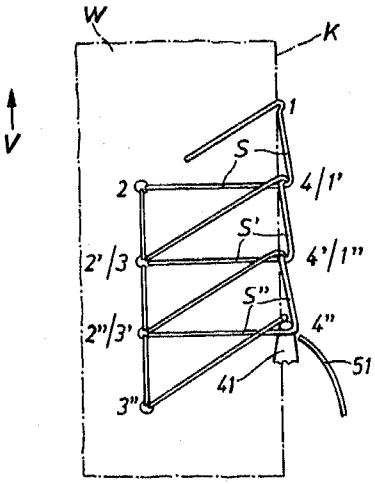
Figure 4:
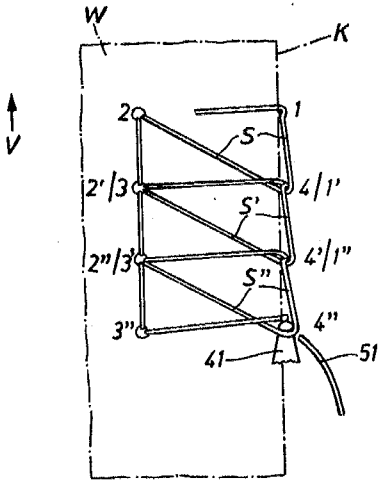

The formation of the overcast seam according to FIG. 5 takes place according to FIG. 4, with the only difference being that the feeding movements of the cloth feed 32 are controlled differently as, namely sewing material W is displaced, after the first looping of needle thread NF and bobbin thread GF in point 1 in the overstitch position I of needle bar 22 by one stitch length in the feeding direction (arrow V) and moves needle bar 22 at the same time into overstitch position II. This is followed after the second abutment member in point 2 by a straight stitch (2-3), after which needle 22 changes into overstitch position I and needle thread NF is drawn out to a loop S for the penetration of needle 26 in point 4 in overstitch position I with reversal of the feeding direction of the sewing material. By this way a further loosening of the thread placed over oversewing tongue 41 is achieved. The tied-up loop S is stripped off from oversewing tongue 41 in the same manner as the seam according to FIG. 4 is produced. The other stitch sequences 1′–4′ and 1″–4″ are formed like stitch sequence 1-4.

Figure 3:
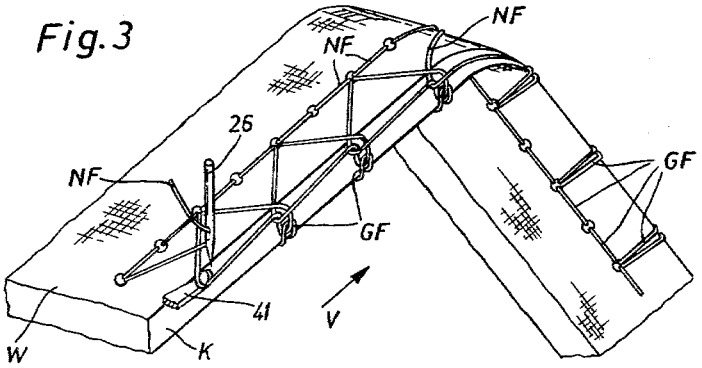
FIG. 3 is a greatly enlarged, perspective view of an overcast seam on the outer edge of the cloth produced according to the new method.
Figure 6:
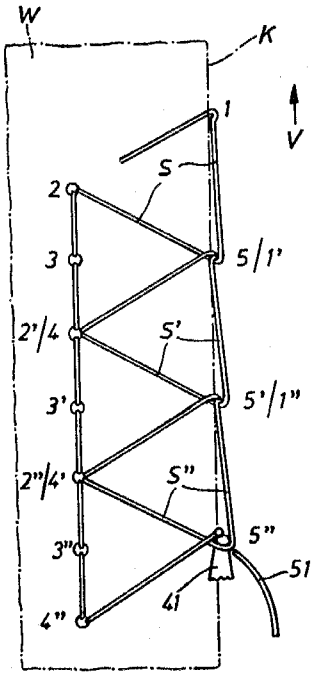
FIGS. 4 to 6 are top views of various overcast seams, likewise greatly enlarged to illustrate the stitch sequence in the formation of a seam according to the new method with FIG. 6 showing the top side of the seam represented in FIG. 3.

The overcast seam according to FIGS. 3 and 6 differs from the seam according to FIG. 5 only in that, after needle bar 22 has changed from the first concatenation of needle and bobbin threads in point 1 to overstitch position II, and after the threads contatentation in point 2, two straight stitches are sewn in overstitch position II. The drawing out of loop S into overstitch position I for the penetration of needle 26 into this loop in point 5 is effected again with reversal of the feeding direction and stripping of loop S from oversewing tongue 41, as in the formation of the seam according to FIGS. 4 and 5.

The swinging motion of the needle bar and the motion of the presser foot are controlled by a corresponding actuation of the zig-zag stitch guide and the feed stitch guide of the sewing machine, preferably through a separate cam plate and a suitable linkage.

While specific embodiments of the invention have been shown and described in detail to illustrate the application of the principles of the invention, it will be understood that the invention may be embodied otherwise without departing from such principles.

What is claimed is:

1. A method of forming an overcast seam using a zig-zag sewing machine with a needle bar carrying a needle with needle thread movable into first and second overstitch positions and having a looper with bobbin thread and a material feeder for feeding material in a feed direction comprising: forming a first loop of needle and bobbin thread with the needle bar in its first overstitch position; moving the needle bar with needle thread into the second overstitch position leaving a loosened thread length, forming a second loop of needle and bobbin thread with the needle in its second overstitch position; forming at least one straight stitch with the needle bar in its second overstitch position in the feed direction of the material; pulling the loosened length of thread into the first overstitch position to form an overstitch loop into which the needle is inserted to form a subsequent loop; moving the needle bar with needle thread into its first overstitch position to form the subsequent loop; and releasing the overstitch loop.

2. A method of forming an overcast seam according to claim 1 further including feeding the material in a reverse feed direction when the needle bar is moved to its first overstitch position.

3. A method of forming an overcast seam according to claim 1 further including forming at least one additional straight stitch with the needle bar in its second overstitch position.

4. A device for forming an overcast seam using a zig-zag sewing machine having a needle bar with needle and needle thread swingable in a swing path into first and second overstitch positions and movable in an axial path, a looper and material feeder for feeding the material in a feed direction comprising: an oversewing tongue having a first and second abutment member positioned respectively in the swing path of the needle bar and in the axial path of the needle bar in its first overstitch position for moving the tongue into two successive positions for forming an overstitch loop in the needle thread, and a loop stripper extending into the path of movement of the oversewing tongue for disengaging the overstitch loop therefrom.

5. A device for forming an overcast seam according to claim 4 further including a shaft for carrying said first and second abutment members, said oversewing tongue connected to said shaft.

6. A device for forming an overcast seam according to claim 5 further including a presser foot for holding the material in the zig-zag sewing machine, said shaft mounted on said presser foot.

7. A device for forming an overcast seam according to claim 6 wherein said shaft is pivotally mounted to said pressure foot, said oversewing tongue comprising an angle lever connected to and movable with said shaft, said loop stripper fixed to said presser foot and extending toward said angle lever.

* * * * *